US005590984A

United States Patent [19]

Assarsson

[11] Patent Number: 5,590,984

[45] Date of Patent: Jan. 7, 1997

[54] METHOD AND SYSTEM FOR INSTALLING LOOSE INSULATION

[75] Inventor: Göran Assarsson, Råå, Sweden

[73] Assignee: Isover Saint-Gobain, Paris La Défense, France

[21] Appl. No.: 293,954

[22] Filed: Aug. 24, 1994

[30] Foreign Application Priority Data

Aug. 25, 1993 [SE] Sweden ..... 9302749

[51] Int. Cl.[6] ..... B65G 53/44

[52] U.S. Cl. ..... 406/32; 406/39; 406/73; 406/122; 406/135; 406/164; 222/81; 222/181.1; 414/412

[58] Field of Search ..... 406/32, 39, 72, 406/73, 121, 122, 135, 164; 198/678.1, 832.1; 414/412, 542; 222/81, 181.1, 181.2

[56] References Cited

U.S. PATENT DOCUMENTS

| | | | |
|---|---|---|---|
| 3,599,682 | 8/1971 | Altmann | 222/81 |
| 3,853,235 | 10/1974 | Lambert et al. | 414/412 |
| 4,199,280 | 4/1980 | Allen . | |
| 4,834,587 | 5/1989 | Crawley et al. | 406/32 |
| 5,403,128 | 4/1995 | Thomas | 406/39 |
| 5,442,895 | 8/1995 | Linson | 414/412 |

FOREIGN PATENT DOCUMENTS 2072352 9/1981 United Kingdom .

*Primary Examiner*—Gary C. Hoge
*Attorney, Agent, or Firm*—Burns, Doane, Swecker & Mathis, L.L.P.

[57] ABSTRACT

In a method and a system for installing loose insulation, loose wool is transported, in compacted state and packed in e.g. filled bags (12), to the site where the insulation operation is to be performed and where loose wool (11) received from the bags is mechanically fluffed, and where the fluffed loose wool is transported by blowing it through a hose (15) to the location where it is to be placed; and the loose wool supplied through the hose (15) is spread on said location in the desired configuration. The novelty of the invention resides in that the bags (12) containing loose wool first are so arranged as to be able, successively and in a controlled manner, to discharge the compacted loose wool contained therein for automatic fluffing and onward blowing through the hose, whereupon from the location where the spreading of loose wool takes place, the discharge of compacted loose wool from the bags is remote-controlled in connection with the spreading, whereby the method can be carried out by a single operator.

11 Claims, 3 Drawing Sheets

METHOD AND SYSTEM FOR INSTALLING LOOSE INSULATION

TECHNICAL FIELD

The present invention relates to a method for installing loose insulation, comprising the steps of transporting insulation material in compacted state packed in a number of units, such as filled bags, bales or the like, to the site where the insulation operation is to be performed, mechanically fluffing insulation material received from said units, transporting the fluffed material by blowing it through a conduit to the location where the insulation material is to be placed, and spreading on said location the insulation material supplied through said conduit in the desired configuration, preferably by varying the direction of discharge of the insulation material through the mouth of said conduit. The invention also relates to a system for installing loose insulation, comprising equipment for fluffing insulation material fed thereinto and blowing the fluffed material onward, and a conduit for transporting onward-blown insulation material from said equipment to a location where the insulation material is to be placed.

The insulation material here concerned is compactible insulation material, such as mineral wool or cellulose material, which will be referred to as loose wool hereinafter.

TECHNICAL BACKGROUND

Insulation by means of loose wool is employed primarily on floor structures. Its use has increased markedly over the past ten years and makes the insulation operation very fast and highly rational, this giving relatively low costs. Moreover, loose-wool insulation is considered to yield excellent insulation results.

The loose wool is normally delivered compacted in bags weighing about 11 kg to contractors performing the insulation work, i.e. the fluffing of the loose wool and the distribution thereof on the location concerned.

The contractor often has a specially-equipped truck, on the platform of which loose-wool fluffing and onward-blow equipment is mounted. On the truck platform are also transported a large number of units, hereinafter referred to as bags, containing compacted loose wool to the site of the insulation operation, which is carried out by two operators manning the truck. One operator, standing on the truck platform, is engaged in moving out and cutting open bags and emptying their contents into the above-mentioned equipment, to which a hose has been connected and pulled up on the floor structure to be insulated. There, the other operator is engaged in spreading the loose wool, i.e. in controlling the placement of the loose wool by manipulating the hose end.

U.S. Pat. No. 4,199,280 discloses equipment for blowing insulation from a supply bin through a distributing hose for placement in a desired area. The supply bin has parallel screw conveyors occupying substantially the entire area of its bottom and serving to supply the loose insulation to a further screw conveyor which advances the insulation to a blower for blowing the insulation through the distributing hose. The operations of the conveyors and the blower are responsive to a separate controller remotely locatable at the distributing nozzle of the distributing hose, whereby a single operator can control the entire operation.

GB 2,072,352 discloses an apparatus for installing insulation comprising a vehicle having a floor structure for storing insulation bales thereon and a blower at the end of the floor structure, the bales being moved toward the blower by means of a movable floor. A first operator loads bales into the blower which blows the insulation through a hose operated by a second operator.

OBJECT OF THE INVENTION

The object of the present invention is to improve the method and the system for loose-wool insulation, making the insulation operation considerably less labour-intensive and significantly reducing the costs therefor.

SUMMARY OF THE INVENTION

The above-mentioned object is achieved by the method and the system according to the invention having the features recited in the appended claims.

The invention thus is based on the insight that the insulation operation can be carried out by a single operator by a combination of controlled, automated feed of suitably prepared bags of loose wool to said equipment and overall remote control of the feed of loose wool from the location where the spreading of loose wool takes place and where the single operator thus stays during the loose-wool spreading operation.

According to the invention, the fluffing and onward-blow equipment (which may be of conventional type) is supplemented with a storage and transport device adapted to receive and, in view of successive feed, store a number of bags containing compacted loose wool. The device is designed to successively feed bags in a controlled manner to an emptying position, in which the bags, once the bag wrapping has been cut open, allow emptying the loose wool contained therein to said equipment. For the purpose of cutting open the bags, controlled cutting means, preferably movable knife means, are provided. The controlled, automatic cutting-open operation is suitably carried out in such a manner that the released loose wool will naturally expand from its compacted state towards and into the loose-wool inlet of said equipment. Advantageously, the cutting-open operation can be initiated by a bag having been fed up to the emptying position.

According to the invention, it is advantageous to provide the wrapping of the bags to be successively fed, with auxiliary cuts cooperating with emptying cuts automatically provided in a controlled manner in the emptying position, for efficiently opening the bags. Preferably, the auxiliary cuts are provided in connection with the placement, i.e. the loading of the bags in the storage and transport device, which suitably takes place on arrival at the working site in preparation of the subsequent loose-wool spreading operation proper.

As those skilled in the art will readily appreciate, the storage and transport device can be designed in many different ways considering its intended function. According to the invention, it is however preferred to arrange the bags in the device by suspending them from a feed track integrated therein for controlled feed to an emptying position over the equipment for fluffing and onward blowing. The suspension of the bags is advantageously provided with the aid of suspension means which are carried by the feed track and which are adapted to cooperate with the bag wrapping, to retain this after the cutting-open thereof and the downward emptying of expanding loose wool, and thereafter to be removed, together with the bag wrapping, from the emptying position, preferably in connection with the feed of a succeeding bag or succeeding bags. As a result, it is efficiently ensured that the loose wool leaves the bag wrapping safely and completely by a combined effect of expansion and gravity without any risk of undesired wrapping material entering the fluffing and onward-blow equipment.

According to the invention, the suspension means advantageously comprise detachable carrier rods, which are each arranged to first be passed through a bag and/or its wrapping, preferably along one side of the unit, and then be placed, together with the bag, in the feed track of the storage and transport device for controlled successive feed up to the emptying position. It is understood that a carrier rod, if so desired, may be capable of carrying more than one bag at a time, which would mean a capacity increase without impairing handleability and performance. In such a case, the inlet width of the fluffing and onward-blow equipment should of course be adapted to several bags hanging beside each other, which of course also goes for the cutting-open means.

According to a preferred embodiment, the bag wrapping is substantially parallelepipedal. In this case, a carrier rod is suitably passed through one end wall of the wrapping, then along and close to the inside of a long side, preferably a narrow side, of the bag wrapping and out through the other end wall of the wrapping, auxiliary cuts being made in the bag wrapping in its opposite long side in the transverse direction and adjacent the respective end wall, these auxiliary cuts extending throughout the major part of the bag side and being extended in one direction into the adjoining side of the wrapping, preferably a broad side thereof. Emptying cuts are later made in said adjoining side across the auxiliary cuts, along and at the lower edge thereof. As a result, a "door" is cut out in the bag wrapping, which essentially consists of said opposite long side (as a rule, the downwardly-facing narrow side) and which can swing downwards to open the bag completely, so that the loose wool drops down towards the underlying fluffing and onward-blow equipment.

As will have been appreciated, the invention thus means that the operator who is to perform the insulation work runs his truck loaded with a number of loose-wool bags to the working site. Once there, he starts by loading the storage and transport device with the required number of filled loose-wool bags (this may also have been previously done) and pulling the transport or feed conduit to the location where the loose wool is to be spread. Along with the conduit, he pulls up a control cable with an associated remote-control unit, to which he has access during the operation of the conduit mouth. At the truck, the control cable is connected to control circuits for the fluffing and onward-blow equipment, the storage and transport device and the cutting-open means. With the aid of the remote-control unit, he is able to control these devices so as to obtain the desired amount and feed rate of the loose wool to be spread.

As to the control operation itself, those skilled in the art will readily realize that several different variants are conceivable. For example, it is possible, at intervals and according to need, to temporarily activate the storage and transport device and the cutting-open means for filling the fluffing and onward-blow equipment, which can be controlled separately or even operate uninterruptedly. It is also possible, by means of the remote-control unit, to control said equipment, which in turn controls the replenishment of loose wool from new bags, e.g. in dependence on the detection of the amount of loose wool in the inlet part of the equipment.

Other features of the invention will appear from the following description of an embodiment with reference to the accompanying drawings.

DESCRIPTION OF AN EMBODIMENT

Figure 1:
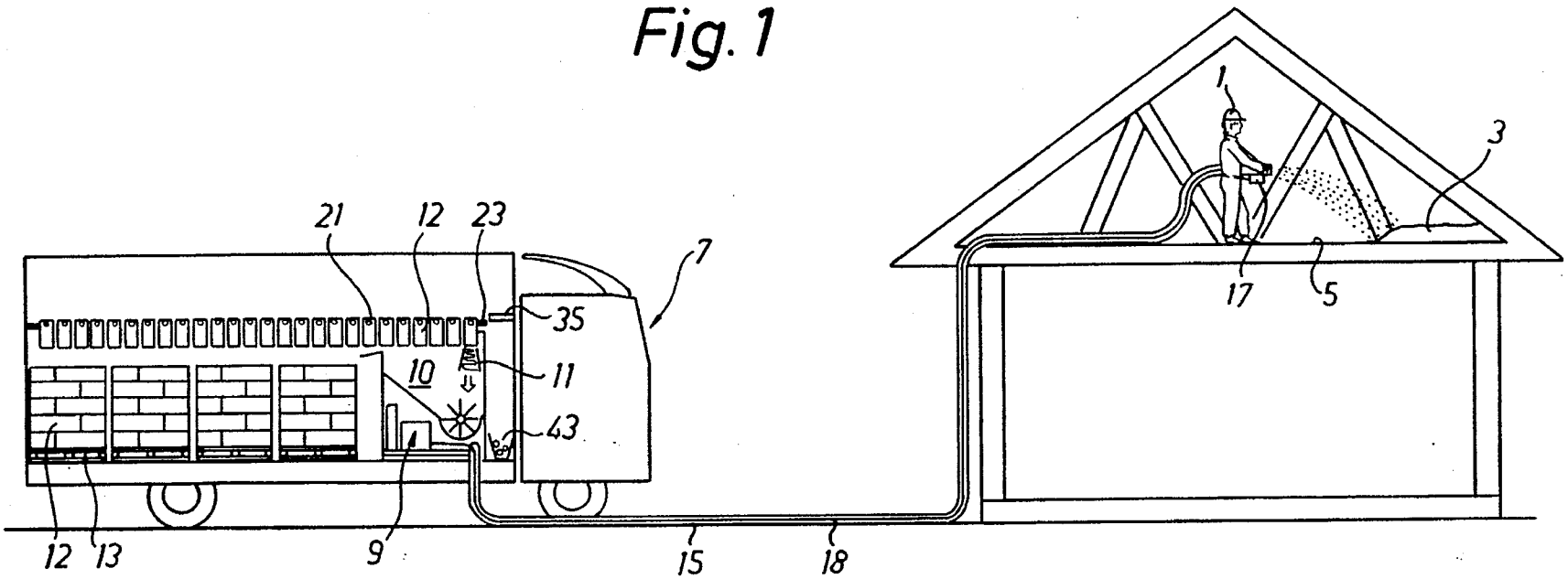
FIG. 1 is a schematic view generally illustrating the use of the present invention in connection with the installation of loose wool on the floor structure of an attic.

FIG. 1 illustrates how an operator 1 can distribute or spread loose wool 3 on to the floor structure 5 of an attic by using a truck 7 modified in accordance with the invention and specially equipped for this type of work. At the front, the truck is provided on its platform with a conventional fluffing and onward-blow equipment 9 having an open-top hopper 10, to which expanding loose wool 11 is intended to be supplied from bags 12 filled with compacted loose wool. The bags have been transported in conventional fashion to the working site, stacked on a number of pallets 13 on the truck platform. A transport hose 15 for the fluffed, onward-blown loose wool has been pulled from the equipment 9 up on the attic floor structure, where its mouth end is manipulated by the operator 1. According to the invention, a remote-control unit 17 is arranged at the mouth end of the hose, so that it can be operated by the operator 1. Via a cable 18 running along the hose 15, the unit 17 is connected to a control unit (not shown in more detail) associated with the equipment 9.

Figure 2:
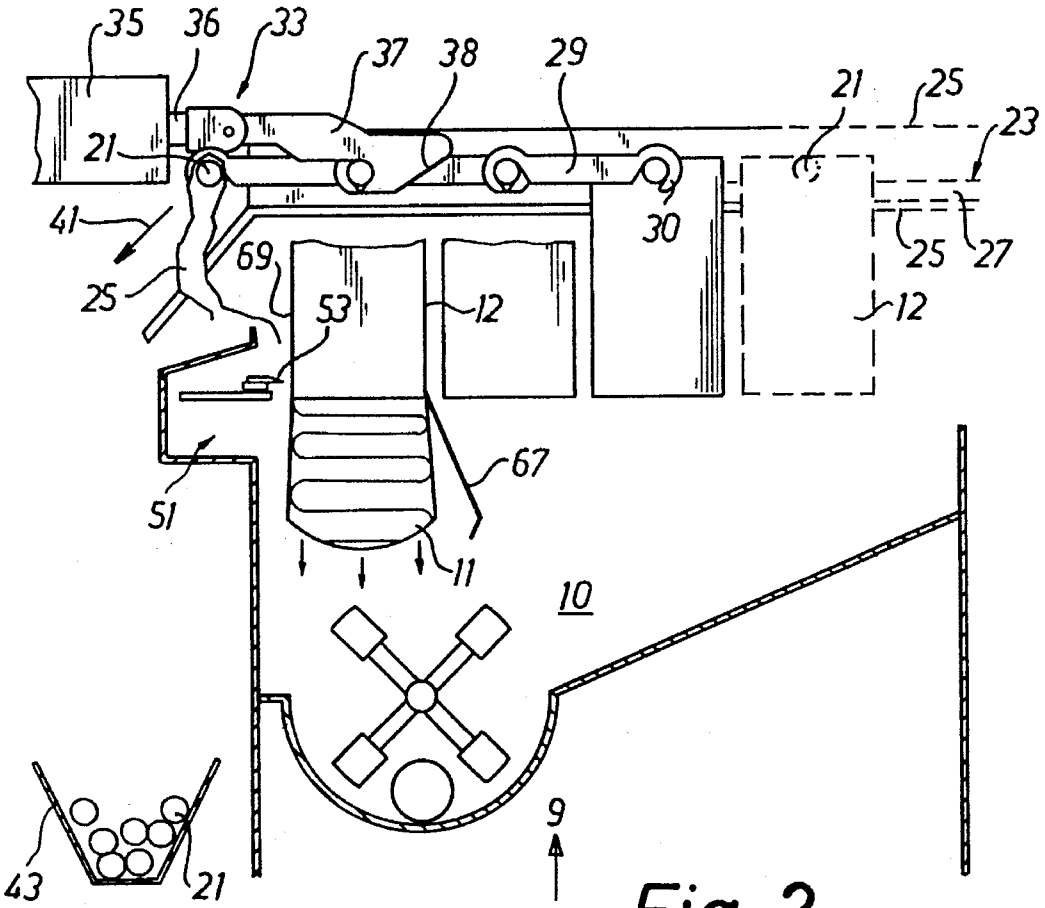
FIG. 2 is a schematic partial side view illustrating the provision of a storage and transport device as well as cutting-open means in conjunction with fluffing and onward-blow equipment, according to a currently preferred embodiment of the present invention.

The bags 12 filled with compacted loose wool are suspended on an elevated level from carrier rods 21 in a row in the longitudinal direction of the truck in a feed track 23 whose design is illustrated in more detail in FIG. 2. The carrier rods 21 extend transversely. In a forward position, the foremost hanging bag is cut open at its bottom so as to permit loose wool 11 to expand and fall into the hopper 10. The emptied bag 25 and the associated carrier rod 21 are thereafter removed in the forward direction, and the row of filled bags 12 is advanced one step, so that the next bag is in position for emptying when the hopper 10 requires filling.

As appears from FIGS. 2 and 23, the feed track 3 includes two top-mounted, parallel L-sections 25 which extend in the longitudinal direction of the truck platform and which are suitably supported by vertical posts (not shown). The distance between the sections 25 corresponds to the length of the carrier rods 21 and is adapted to the length of the bags 12. As a rule, each rod 21 carries but one bag, the width of the feed track then being so small that it can be arranged along one long side of the platform while leaving a free space beside it, thus yielding a considerable handling and loading space. Since the bags are suspended on an elevated level on the truck platform, it is of course possible also to make use of the space below, e.g. for placing pallets with filled bags. It is understood that it may also be possible to make the feed track 23 wider and to suspend special, longer bags on each carrier rod, or up to three ordinary bags on each carrier rod. The bags used may also be wider, i.e. have a larger vertical dimension in FIG. 1, without this causing any problems.

On the horizontal, mutually facing flanges of the sections 25 are provided slide rails 27, on which the end portions of the carrier rods 21 slide in connection with the stepwise feed towards the emptying position. The carrier rods 21 with the bags 12 suspended therefrom are interconnected by means of short links 29 having at each end a hook 30 releasably engaging around the respective carrier rod 21. In the top face of the slide rails 27 is formed a longitudinal guide groove 31 for the links 29.

For the controlled, stepwise feed of the carrier rods, there is a front-mounted pneumatic traction mechanism 33 operating in the longitudinal direction and comprising a cylinder 35 with an associated piston rod 36, on whose free end a traction hook 37 is pivotally mounted. When the piston rod moves out of the cylinder, the bevelled end 38 of the traction hook 37 passes up over the next carrier rod, such that the traction hook is brought into engagement therewith. When the piston rod is retracted into the cylinder, all the carrier rods linked together and the bags are pulled one step forward to the position shown in FIG. 2. At the same time, the formerly foremost carrier rod with the emptied bag wrapping 26 hanging thereon is advanced so as to fall down from the feed track 23 in front of the equipment 9 together with the foremost links 29, as indicated by the arrow 41 in FIG. 2. The dropping parts are collected in a container 43 on the platform in front of the equipment 9 and may later be used anew when loading bags in the storage and transport direction the next time.

Figure 5:
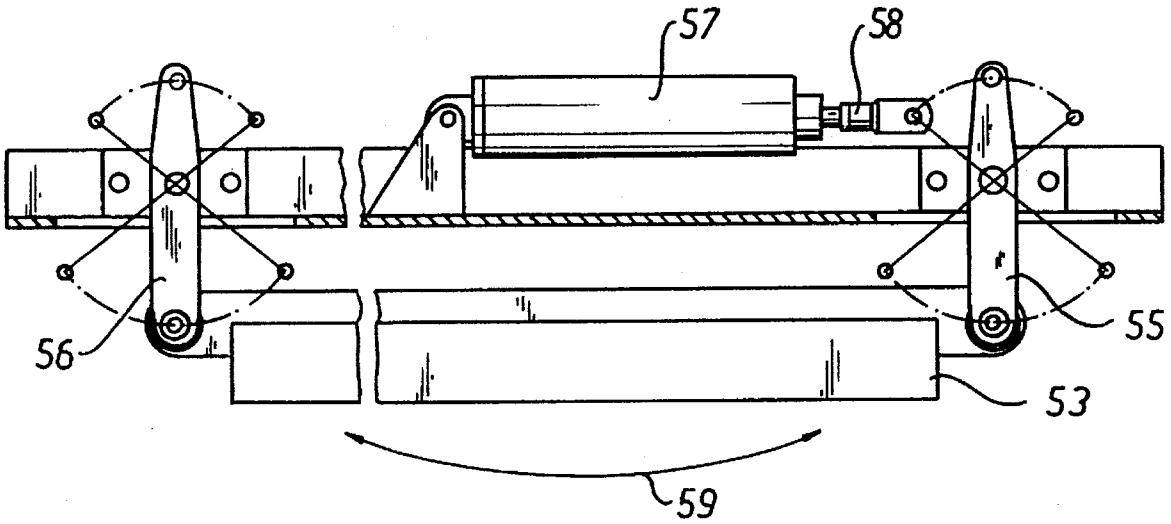
FIG. 5 is a schematic partial view from above of the cutting-open means employed.
Figure 6:
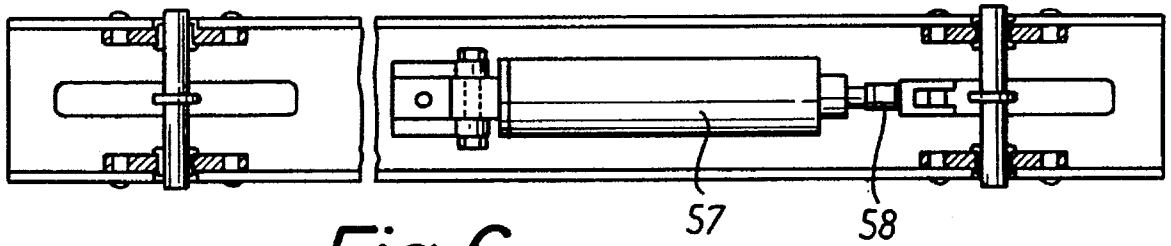
FIG. 6 is a schematic front view of the means in FIG. 5.
Figure 7:
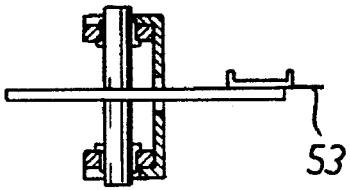
FIG. 7 is a schematic side view of the means in FIGS. 5 and 6.

At the top of the front part of the equipment 9, there is provided a cutting-open mechanism 51. This also operates pneumatically and has a movable cutting blade 53 which extends transversely with an extent corresponding to the transverse extent of the bags. As appears from FIGS. 5–7, the cutting blade 53 is rotatably fixed at the respective end to one end of link arms 55, 66 which are centrally pivotally mounted and the pivotal movement of which is produced by means of the piston rod 58 of a pneumatic cylinder 57, this piston rod being rotatably fixed to the other end of one link arm 55. As is readily appreciated and as indicated by the arrow 59, the cutting blade 53 will execute an arcuate cutting motion when the piston rod 58 is extended and retracted, this cutting motion being adapted to provide the desired emptying cut on the foremost bag 12 located in the emptying position.

Figure 3:
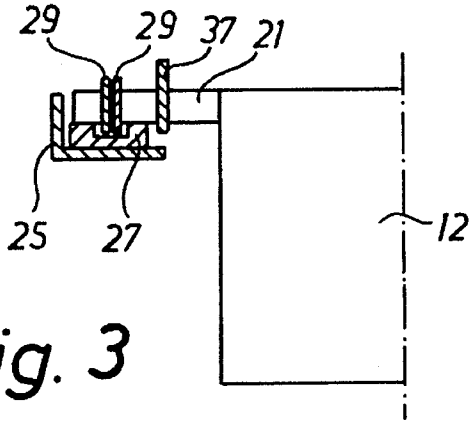
FIG. 3 is a schematic partial cross-sectional view illustrating the suspension of a bag-supporting carrier rod on a feed track in the storage and transport device.
Figure 4:
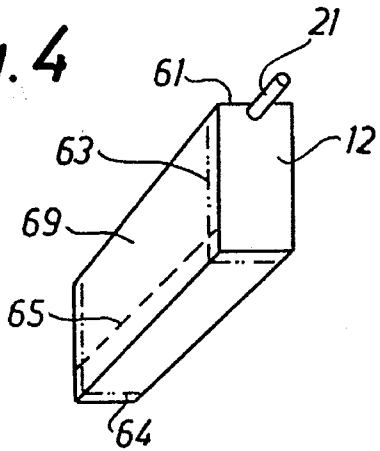
FIG. 4 is a schematic perspective view showing a loose-wool bag with a pertaining carrier rod applied, as well as the positions of auxiliary cuts and emptying cuts.

FIGS. 3 and 4 illustrate how a carrier rod 21, which may be suitably pointed at one end, is passed through a bag 12 through the two end walls thereof and along and just below the upper narrow side 61 of the bag wrapping. FIG. 4 also illustrates by dash-dot lines the auxiliary cuts 63, 64 provided in the bag wrapping, suitably in connection with the application of the carrier rod before being suspended from the feed track 23. This figure also shows by a dashed line 65 how the emptying cut is provided by means of the mechanism 51 in connection with the emptying of the loose wool from the bag in the emptying position over the equipment 9. As shown in FIG. 2, said cut entails the formation of a "bag door" 67 which can swing downward, such that the loose wool 11 can be easily emptied out. To this also contributes the fact that the forwardly-facing bag wrapping side 69 will also be partially cut out and can easily be pressed aside by the expanding, dropping loose wool 11.

As to the control of the equipment 9, the cylinder 35 and the cylinder 57 for obtaining the desired function, it is also obvious to those skilled in the art how to achieve it by simple conventional means, which evidently makes a detailed description thereof superfluous.

I claim:

1. A method for installing loose insulation, comprising the steps of transporting insulation material in compacted state packed in a number of units to the site where the insulation operation is to be performed, mechanically fluffing insulation material received from the units, transporting the fluffed material by blowing it through a conduit to the location where the insulation material is to be placed, and spreading on the location the insulation material supplied through the conduit in the desired configuration, and comprising the further steps of first arranging the insulation material units for controlled feed in a succession to an emptying position, at which a unit fed thereto is automatically cut open in a controlled manner, so that the compacted insulation material of the unit expands out of it and is discharged for the mechanical fluffing, the wrapping of the unit being retained and removed after the discharge of the insulation material, providing the wrappings of the thus arranged units with auxiliary cuts cooperating with emptying cuts provided automatically and in a controlled manner in the emptying position for opening the respective units, and thereafter, in connection with the spreading of the insulation material, remote-controlling from the location where the insulation material is being spread, the discharge by the units of compacted insulation material, whereby the method can be carried out by a single operator, wherein the units are arranged by suspending them from a feed track, by means of a carrier rod which is passed through the unit and/or through the wrapping, for controlled feed to the emptying position over equipment for the mechanical fluffing and onward blowing the carrier rod being supported by the feed track, the wrapping being substantially parallelepipedal and wherein the carrier rod is passed through one end wall of the wrapping, then along and close to an inside of a long side of the wrapping and out through another end wall of the wrapping, auxiliary cuts being made in the wrapping in an opposite long side in a transverse direction and adjacent a respective end wall, the auxiliary cuts extending throughout a major part of the side and being extended in one direction into an adjoining side of the wrapping, and wherein emptying cuts are made in the adjoining side across the auxiliary cuts along and at a lower edge thereof.

2. A method as claimed in claim 1, wherein the carrier rod is caused to engage the wrapping in such a manner that, after the wrapping has been cut open and the associated unit has been emptied, the carrier rod retains the wrapping, whereupon the carrier rod, together with the wrapping, is removed from the emptying position.

3. A method as claimed in claim 1, wherein the remote control comprises the step, from the location where the spreading of the insulation material takes place, of activating, according to need, the discharge of compacted insulation material to the equipment for the mechanical fluffing and onward blowing.

4. A method as claimed in claim 1, wherein the remote control comprises the step, from the location where the spreading of the insulation material takes place, of controlling the equipment for the mechanical fluffing and onward blowing, and wherein the discharge of compacted insulation material to the equipment is controlled by the latter in dependence on the detection of the amount of insulation material in the equipment.

5. A method for installing loose insulation comprising the steps of transporting insulation material in compacted state packed in a number of units to the site where the insulation operation is to be performed, mechanically fluffing insulation material received from the units, transporting the fluffed material by blowing it through a conduit to the location where the insulation material is to be placed, and spreading on the location the insulation material supplied through the conduit in the desired configuration, and comprising the further steps of first arranging the units containing insulation material, such that the units can discharge successively and in a controlled manner the compacted insulation material contained therein for automatic fluffing and onward blowing through the conduit, by suspending them from a feed track for controlled feed to an emptying position over equipment for the mechanical fluffing and onward blowing, and suspending each insulation material unit by means of a carrier rod which is passed through the unit and/or through the wrapping, the carrier rod being supported by the feed track, and thereafter, in connection with the spreading of the insulation material, remote-controlling from the location where the insulation material is being spread, the discharge by the units of compacted insulation material, whereby the method can be carried out by a single operator, wherein the wrapping is substantially parallelepipedal and wherein the carrier rod is passed through one end wall of the wrapping, then along and close to an inside of a long side of the wrapping and out through another end wall of the wrapping, auxiliary cuts being made in the wrapping in an opposite long side in a transverse direction and adjacent a respective end wall, the auxiliary cuts extending throughout a major part of the side and being extended in one direction into an adjoining side of the wrapping, and wherein emptying cuts are made in the adjoining side across the auxiliary cuts, along and at a lower edge thereof.

6. A method as claimed in claim 5, wherein the wrappings of the units thus arranged are provided with auxiliary cuts cooperating with emptying cuts provided automatically and in a controlled manner in the emptying position for opening the respective units.

7. A method as claimed in claim 5, wherein the remote control comprises the step, from the location where the spreading of the insulation material takes place, of activating, according to need, the discharge of compacted insulation material to the equipment for the mechanical fluffing and onward blowing.

8. A method as claimed in claim 5, wherein the remote control comprises the step, from the location where the spreading of the insulation material takes place, of controlling the equipment for the mechanical fluffing and onward blowing, and wherein the discharge of compacted insulation material to the equipment is controlled by the latter in dependence on the detection of the amount of insulation material in the equipment.

9. A method as claimed in claim 6, wherein the carrier rod is caused to engage the wrapping in such a manner that, once the wrapping has been cut open and the associated unit has been emptied, the carrier rod retains the wrapping, whereupon the carrier rod, together with the wrapping, is removed from the emptying position.

10. A system for installing loose insulation comprising equipment for fluffing insulation material fed thereinto and blowing the fluffed material onward, and a conduit for transporting onward-blown insulation material from the equipment to the location where the insulation material is to be placed, a storage and transport device for receiving and storing a number of units which each have compacted insulation material packed in a wrapping, the device being adapted to feed units successively and in a controlled manner to an emptying position for discharging the pertaining insulation material to the equipment for fluffing and onward blowing of the insulation material, means for controlled cutting-open of units located in the emptying position, such that the insulation material contained therein can be discharged, and control means for controlling the storage and transport device, cutting-open means and the equipment, the control means comprising remote-control means to be operated on the location where the insulation material is to be placed, such that overall control of the onward blowing of insulation material can be carried out from the location, wherein the storage and transport device comprises means for suspending insulation material units, and means for successively feeding the suspension means in a controlled manner along a feed track to the emptying position, the suspension means suspending units such that the units hang above the fluffing and onward-blow equipment, the suspension means including carrier rods which are each adapted to be applied through an insulation material unit and/or its wrapping, the carrier rods being supported in a manner to permit feed thereof in the storage and transport device in a controlled manner, the wrapping being substantially parallelepipedal, the carrier rod being of sufficient size to pass through one end wall of the wrapping, then along and close to an inside of a long side of the wrapping and out through an opposite end wall of the wrapping, the cutting-open means being configured for making auxiliary cuts in the wrapping in an opposite long side of the wrapping in a transverse direction and adjacent a receptive end wall, the auxiliary cuts extending throughout a major part of the side and being extended in one direction into an adjoining side of the wrapping, and for making emptying cuts in the adjoining side across the auxiliary cuts, along and at a lower edge of the adjoining side.

11. A system as claimed in claim 10, wherein the suspension means is adapted to cooperate with the wrapping of a unit, to retain the wrapping after it has been cut open and the insulation material has been discharged, and thereafter to be removed, together with the wrapping, from the emptying position.

* * * * *